US011268215B2

(12) United States Patent
Cho et al.

(10) Patent No.: US 11,268,215 B2
(45) Date of Patent: Mar. 8, 2022

(54) METHOD OF PRODUCING CARBON FIBER

(71) Applicant: HPK INC., Gyeonggi-do (KR)

(72) Inventors: Chang Hyun Cho, Gyeonggi-do (KR); Chang Se Woo, Gyeonggi-do (KR); Kap Seung Yang, Gwangju (KR); Chang Ha Lim, Gyeonggi-do (KR); Sun Ho Choe, Jeollabuk-do (KR); Hong Min Kim, Jeollabuk-do (KR); Kyung Ae Oh, Jeollabuk-do (KR); Eun Ji Kim, Jeollabuk-do (KR)

(73) Assignee: HPK INC., Pyeongtaek-si (KR)

( * ) Notice: Subject to any disclaimer, the term of this patent is extended or adjusted under 35 U.S.C. 154(b) by 0 days.

(21) Appl. No.: 16/845,570

(22) Filed: Apr. 10, 2020

(65) Prior Publication Data

US 2020/0378034 A1 Dec. 3, 2020

(30) Foreign Application Priority Data

| | | |
|---|---|---|
| May 31, 2019 | (KR) | 10-2019-0064909 |
| Jul. 31, 2019 | (KR) | 10-2019-0093174 |
| Feb. 3, 2020 | (KR) | 10-2020-0012719 |
| Feb. 3, 2020 | (KR) | 10-2020-0012745 |

(51) Int. Cl.

| | |
|---|---|
| ***D01F 9/22*** | (2006.01) |
| ***D01D 10/06*** | (2006.01) |
| *D01D 5/08* | (2006.01) |

(52) U.S. Cl.

CPC ..... *D01F 9/225* (2013.01); *D01D 10/06* (2013.01); *D01D 5/08* (2013.01)

(58) Field of Classification Search

CPC ..... D01F 9/225

See application file for complete search history.

(56) References Cited

U.S. PATENT DOCUMENTS

| | | | | |
|---|---|---|---|---|
| 4,163,770 | A | 8/1979 | Porosoff | |
| 4,944,932 | A * | 7/1990 | Shiromoto | D01F 9/22 264/29.2 |
| 9,644,290 | B2 * | 5/2017 | Yu | D01D 1/04 |
| 2010/0003515 | A1 * | 1/2010 | Tanaka | C08F 20/44 428/367 |
| 2016/0258082 | A1 * | 9/2016 | Rios | D01F 9/14 |
| 2017/0217125 | A1 * | 8/2017 | Li | B32B 25/14 |
| 2019/0100856 | A1 | 4/2019 | Knoop et al. | |

FOREIGN PATENT DOCUMENTS

| | | | |
|---|---|---|---|
| CN | 109402792 | A | 3/2019 |
| JP | 2014012917 | A | 1/2014 |
| JP | 2018535301 | A | 11/2018 |
| JP | 2019513167 | A | 5/2019 |
| WO | 2017167355 | A1 | 10/2017 |

OTHER PUBLICATIONS

C. David Warren, "Carbon Fiber Precursors and Conversion" Oak Ridge National Laboratory managed by UT—Battelle for the Department of Energy, 2016, pp. 1-36.

Korean Notice of Allowance (Application No. 10-2020-0012719) dated Apr. 16, 2020.

European Search Report for Application No. 20 168 440.4 dated Oct. 9, 2020.

* cited by examiner

*Primary Examiner* — Timothy Kennedy
*Assistant Examiner* — Alexander A Wang
(74) *Attorney, Agent, or Firm* — STIP Law Group, LLC

(57) ABSTRACT

Provided is a method of producing a carbon fiber, the method including: a) adding an acrylonitrile-based polymer solution to a solution containing a glycol-based compound having a boiling point of 180 to 210° C. to precipitate an acrylonitrile-based polymer; b) melt spinning the acrylonitrile-based polymer to obtain a spun fiber; and c) performing stabilization and carbonization on the spun fiber to obtain a carbon fiber.

16 Claims, No Drawings

METHOD OF PRODUCING CARBON FIBER

CROSS-REFERENCE TO RELATED APPLICATIONS

This application claims priority under 35 U.S.C. § 119 to Korean Patent Application No. 10-2019-0064909, filed on May 31, 2019, to Korean Patent Application No. 10-2019-0093174, filed on Jul. 31, 2019, to Korean Patent Application No. 10-2020-0012719, filed on Feb. 3, 2020 and to Korean Patent Application No. 10-2020-0012745, filed on Feb. 3, 2020 in the Korean Intellectual Property Office, the disclosure of which is incorporated herein by reference in its entirety.

TECHNICAL FIELD

The following disclosure relates to a method of producing a carbon fiber from an acrylonitrile-based polymer. More particularly, the following disclosure relates to a method of producing a carbon fiber with enhanced productivity by melt spinning at high wind-up speed, and having comparable mechanical properties with the commercial carbon fiber.

BACKGROUND

A carbon fiber is a reinforcing fiber for composite materials that may replace a metal due to its unique and excellent modulus of elasticity, and high strength as compared to those of other fibers, and has been widely used for advanced materials used in sports, aerospace, and the like. Such a carbon fiber is limited in use for general purposes due to its relatively high cost compared to those of other materials. Therefore, the demands for a productivity and production stability of the carbon fiber have been concentrated in order to widen applicable ranges for general purposes such as a vehicle, civil engineering, construction, a pressure vessel, and a blade of a windmill.

A commercially available carbon fiber has very excellent mechanical properties such as a tensile strength of 3.5 to 6.4 GPa, a tensile modulus of 230 to 294 GPa, and an elongation of 1.4 to 1.6%; however, its price is 22 to 176 dollars per kilogram, which is very expensive. Therefore, the carbon fiber has not been commonly used. Accordingly, the United States Department of Energy (DOE) is asking for a carbon fiber having a tensile strength of 1.72 GPa, which is half that of a commercially available product, in order to use the carbon fiber for a vehicle composite material that is rapidly increasing in demand, but the price of the carbon fiber for satisfying the tensile strength is suggested at a very low price of 11.0 to 15.4 dollars per kilogram (Report: Oak Ridge National Lab, 2017). The currently commercialized process is a wet spinning method, but it is not possible to satisfy the price and the physical properties proposed by the DOE with the existing wet spinning method.

Specifically, a carbon fiber produced from an acrylonitrile-based polymer that has been most widely used among carbon fibers has a melting point higher than a decomposition temperature of the polymer due to a strong interaction between molecules or in molecules of a nitrile group in the acrylonitrile-based polymer. The acrylonitrile-based polymer is not capable of being melt spun due to its high melting point, and thus the carbon fiber has been produced only by wet spinning or dry spinning.

According to the method as described above, the polymer is spun in a solidifying bath and in a high temperature steam atmosphere, and then a spun fiber is precipitated while a solvent in the spun fiber diffuses out and is switched into a non-solvent, thereby producing a fiber. Therefore, it is possible to produce a carbon fiber having excellent physical properties, but improving a slow spinning speed and adding processes for recovery, recycling, and disposal of the solvent are required. As a result, the carbon fiber is not cost effective and has a significantly low cost competitiveness due to enormous energy amounts of consumption as compared to those of other materials.

In addition, the spun fiber produced by a wet spinning or dry spinning method is usually limited to implementation of a winding speed of 100 m/min or more in a winding process, and is thus disadvantageous in terms of low cost production relative to high speed production.

Therefore, there is a need for the development of a new spinning method capable of implementing a carbon fiber that has excellent physical properties, a high spinning speed, and a high fluidity, is freely changed in shape, and may thus be widely applicable in various fields.

Accordingly, the carbon fiber is required to have unique excellent mechanical properties and a high spinning speed to enable to be fibrillated, and to contribute to wide applicable ranges for various and general purposes. In addition, there is a need to provide a method of producing a carbon fiber having excellent mechanical properties and high cost competitiveness and capable of being used for various purposes.

SUMMARY

An embodiment of the present invention is directed to providing a new method of producing a carbon fiber from an acrylonitrile-based polymer capable of being melt spun and having a high spinning speed.

Another embodiment of the present invention is directed to providing a method of producing a carbon fiber having excellent mechanical properties and capable of being widely used for general purposes with a high cost competitiveness as compared to that of a carbon fiber produced by wet spinning or dry spinning.

Still another embodiment of the present invention is directed to providing a method of producing a carbon fiber capable of significantly increasing a winding speed of a spun fiber and implementing a fine average diameter of the carbon fiber.

In one general aspect, a method of producing a carbon fiber includes: a) adding an acrylonitrile-based polymer solution to a solution containing a glycol-based compound having a boiling point of 180 to 210° C. to precipitate an acrylonitrile-based polymer; b) melt spinning the acrylonitrile-based polymer to obtain a spun fiber; and c) performing stabilization and carbonization on the spun fiber to obtain a carbon fiber.

The glycol-based compound may be C2-C10 alkylene glycol.

The glycol-based compound may be one or a mixture of two or more selected from the group consisting of ethylene glycol, propylene glycol, butylene glycol, pentylene glycol, and hexylene glycol.

The acrylonitrile-based polymer may have a repeating unit derived from an acrylonitrile monomer and an acrylic monomer.

The method may further include, after the b), winding the spun fiber at a winding speed of 100 to 3,000 m/min.

After the winding, an average diameter of the spun fiber may be 1 to 50 μm.

The acrylonitrile-based polymer may have the repeating unit including 50 to 97 mol % of the acrylonitrile monomer and 3 to 50 mol % of the acrylic monomer.

The method may further include, after the a), drying the acrylonitrile-based polymer.

After the drying, a content of the glycol-based compound in the acrylonitrile-based polymer may be 5 to 15 wt % with respect to a total weight of the acrylonitrile-based polymer.

The method may further include, after the b), drawing the spun fiber.

The drawing may be performed at 100 to 250° C.

In the c), the stabilization may be performed at 120 to 300° C.

In the c), the carbonization may be performed at 800 to 3,000° C. in an inert gas atmosphere.

Other features and aspects will be apparent from the following detailed description, the drawings, and the claims.

DETAILED DESCRIPTION OF EMBODIMENTS

Hereinafter, a method of producing a carbon fiber according to the present invention will be described in more detail with reference to the following exemplary embodiments. However, the following exemplary embodiments are only reference examples for describing the present invention in detail, and the present invention is not limited thereto and may be implemented in various forms.

In addition, unless otherwise defined, all technical terms and scientific terms have the same meanings as commonly understood by those skilled in the art to which the present invention pertains. The terms used herein are only for effectively describing a certain example rather than limiting the present invention.

The term "alkylene" used herein refers to a divalent organic radical derived from a saturated hydrocarbon consisting of carbon and hydrogen atoms only.

The term "spun fiber" used herein refers to a spun fiber obtained by winding the spun fiber after melt spinning. The term "precursor spun fiber" refers to a drawn fiber before being a stabilized and carbonized fiber.

The present invention for achieving the above object relates to a method of producing a carbon fiber.

The present invention will be described below in detail.

A method of producing a carbon fiber according to the present invention includes: a) adding an acrylonitrile-based polymer solution to a solution containing a glycol-based compound having a boiling point of 180 to 210° C. to precipitate an acrylonitrile-based polymer; b) melt spinning the acrylonitrile-based polymer to obtain a spun fiber; and c) performing stabilization and carbonization on the spun fiber to obtain a carbon fiber.

An acrylonitrile-based polymer according to the related art has a melting point higher than a decomposition temperature thereof, and is thus impossible to be melt spun. For this reason, a carbon fiber has been produced from the acrylonitrile-based polymer only by wet spinning or dry spinning.

The carbon fiber produced by such a method has excellent mechanical properties. However, in such a method, a solvent is indispensable during a spinning process, and thus additional processes for recovery, recycling, and disposal of the solvent are required. In addition, the method is limited in extensive use due to low cost competitiveness caused by a large amount of the solvent used.

Therefore, in order to solve the above problems of the related art, the present inventors have attempted to perform melt spinning by obtaining a powdery acrylonitrile-based polymer, and then simply mixing various plasticizers. However, in this case, an evenness and mechanical properties of a carbon fiber significantly deteriorate.

Accordingly, in order to solve the above problems, the present inventors found that in a case where an acrylonitrile-based polymer solution is added to a solution containing a glycol-based compound to precipitate an acrylonitrile-based polymer, and the obtained acrylonitrile-based polymer is melt spun, the costs may be reduced due to a simple process, and thus cost competitiveness may be ensured as compared to wet spinning and dry spinning, thereby completing the present invention.

As described above, since the cost-effective carbon fiber may be provided for general use, and may have significantly improved mechanical properties, the above method is an innovative production method that may escape the constraints that occur in the acrylonitrile-based polymer according to the related art.

Specifically, in the method of producing a carbon fiber according to the present invention, first, in the a), an acrylonitrile-based polymer solution is added to a solution containing a glycol-based compound having a boiling point of 180 to 210° C. to precipitate an acrylonitrile-based polymer.

Furthermore, the acrylonitrile-based polymer solution is added to the glycol-based compound solution having a boiling point in a specific range as described above to precipitate an acrylonitrile-based polymer, such that it is possible to obtain an acrylonitrile-based polymer capable of being melt spun. In addition, a carbon fiber produced therefrom may have a high crystallinity, and significantly excellent tensile strength, tensile modulus, and elongation. The effect as described above may be achieved by precipitating the acrylonitrile-based polymer by adding the acrylonitrile-based polymer solution to the glycol-based compound solution, and cannot be exerted by simply mixing an acrylonitrile-based polymer and a glycol-based compound.

According to an exemplary embodiment of the present invention, the boiling point of the glycol-based compound may be 180 to 210° C. and preferably 180 to 200° C. By using the glycol-based compound having the boiling point as described above, when performing melt spinning at a temperature lower than the temperature at which the acrylonitrile-based polymer is cyclized or stabilized, a residual content of the glycol-based compound in the acrylonitrile-based polymer may be minimized, the acrylonitrile-based polymer capable of being melt spun may be obtained, and a carbon fiber produced therefrom may have a high crystallinity and mechanical strength.

According to an exemplary embodiment of the present invention, the glycol-based compound is not particularly limited as long as it has the boiling point described above. For example, the glycol-based compound may be C2-C10 alkylene glycol and preferably C2-C6 alkylene glycol. Specifically, the glycol-based compound may be one or a mixture of two or more selected from the group consisting of ethylene glycol, propylene glycol, butylene glycol, pentylene glycol, and hexylene glycol. Preferably, the glycol-based compound may be one or a mixture of two or more selected from the group consisting of ethylene glycol, propylene glycol, and pentylene glycol.

According to an exemplary embodiment of the present invention, a solvent contained in the glycol-based compound solution refers to a non-solvent that may dissolve or disperse the glycol-based compound and may also precipitate the acrylonitrile-based polymer. More specifically, the solvent refers to a solvent that does not dissolve the acrylonitrile-based polymer while having an excellent compatibility with an organic solvent in the acrylonitrile-based polymer solution.

According to a preferred exemplary embodiment of the present invention, the solvent may be water. Accordingly, the glycol-based compound solution may be an aqueous glycol-based compound solution. A content of the glycol-based compound contained in the aqueous solution may be 20 to 60 vol % and preferably 30 to 50 vol %, based on a total volume of the aqueous solution.

According to an exemplary embodiment of the present invention, by using the aqueous glycol-based compound solution, the acrylonitrile-based polymer may be uniformly plasticized when being precipitated and may be melt spun, and defects in the spun fiber may be prevented, unlike another non-solvent having a high boiling point.

In addition, the glycol-based compound may be contained in the polymer in an amount at which the above effect may be exerted.

According to an exemplary embodiment of the present invention, the acrylonitrile-based polymer may have a repeating unit derived from an acrylonitrile monomer and an acrylic monomer. Preferably, the acrylonitrile-based polymer may have the repeating unit including 50 to 97 mol % of the acrylonitrile monomer and 3 to 50 mol % of the acrylic monomer. More preferably, the acrylonitrile-based polymer may have the repeating unit including 86 to 97 mol % of the acrylonitrile monomer and 3 to 24 mol % of the acrylic monomer. Most preferably, the acrylonitrile-based polymer may have the repeating unit including 90 to 97 mol % of the acrylonitrile monomer and 3 to 10 mol % of the acrylic monomer. When the acrylonitrile-based polymer has the repeating unit of the above content, melting and drawing of the acrylonitrile-based polymer may be induced to obtain a spun fiber. When the spun fiber produced therefrom is stabilized, a shape of the spun fiber may be prevented from being collapsed due to thermal melting. Therefore, a carbon fiber having a high density may be produced. Furthermore, the acrylonitrile-based polymer is capable of being melt spun even when the acrylic monomer is included in an amount of 15 mol % or less, and a carbon fiber having improved mechanical properties may thus be produced therefrom. Therefore, the carbon fiber is excellent for a variety of applications requiring excellent mechanical properties.

According to an exemplary embodiment of the present invention, the acrylic monomer may be one or a mixture of two or more selected from the group consisting of acrylic acid, methacrylic acid, methyl acrylate, ethyl acrylate, n-butyl acrylate, t-butyl acrylate, 2-ethylhexyl acrylate, methyl methacrylate, ethyl methacrylate, n-butyl methacrylate, t-butyl methacrylate, 2-ethylhexyl methacrylate, lauryl methacrylate, and benzyl methacrylate. When the acrylonitrile-based polymer has the repeating unit derived from the acrylic monomer described above, melting and drawing of the acrylonitrile-based polymer may be induced, a stabilization time of the spun fiber may be shortened, a stabilization temperature of the spun fiber may be lowered, and the spun fiber may be prevented from being severed.

According to an exemplary embodiment of the present invention, the acrylonitrile-based polymer solution may be a solution containing an acrylonitrile-based polymer obtained by polymerizing a composition containing an acrylonitrile monomer, an acrylic monomer, and an organic solvent.

According to an exemplary embodiment of the present invention, the organic solvent is a solvent that may dissolve the monomer of the acrylonitrile-based polymer. For example, the organic solvent may be one solvent or a mixed solvent of two or more selected from an ether-based solvent, an alcohol-based solvent, an aromatic solvent, an alicyclic solvent, a heteroaromatic solvent, a heteroalicyclic solvent, an alkane-based solvent, a ketone-based solvent, and a halogenated solvent. Specifically, the organic solvent may be one or a mixed solvent of two or more selected from chloroform, acetone, methanol, ethanol, isopropanol, benzene, toluene, xylene, cyclohexane, n-hexane, pyridine, dimethylformamide, dimethylacetamide, dimethylsulfoxide, N-methylpyrrolidone, 2-methyltetrahydrofuran, dimethyl ether, dibutyl ether, and tetrahydrofuran, but the present invention is not limited thereto.

According to an exemplary embodiment of the present invention, a weight average molecular weight of the acrylonitrile-based polymer produced in the a) may be 10,000 to 500,000 g/mol and preferably 10,000 to 300,000 g/mol, but is not limited thereto.

According to an exemplary embodiment of the present invention, the method may further include, after the a), drying the acrylonitrile-based polymer. By performing the drying, after the precipitation, water or the solvent remaining in the acrylonitrile-based polymer may be removed. The drying method is not particularly limited, and the drying may be performed by a drying unit generally used. As a specific example, moisture may be selectively removed by performing heating by which absorption is performed by water molecules, with electromagnetic waves such as microwaves or infrared rays. Alternatively, the acrylonitrile-based polymer may be dried at room temperature for 1 to 48 hours and preferably at room temperature for 1 to 24 hours, and then may be additionally vacuum dried at 50 to 120° C. for 1 to 36 hours and preferably at 60 to 90° C. for 1 to 16 hours. However, the present invention is not limited thereto.

According to an exemplary embodiment of the present invention, after the drying, a content of the glycol-based compound in the acrylonitrile-based polymer may be 5 to 15 wt %, preferably 5 to 14 wt %, and more preferably 7 to 14 wt %, with respect to a total weight of the acrylonitrile-based polymer.

In the acrylonitrile-based polymer precipitated and obtained by adding the acrylonitrile-based polymer solution to the glycol-based compound solution, after the drying, the glycol-based compound may be uniformly present in the polymer. Therefore, the acrylonitrile-based polymer is capable of being melt spun and capable of being stably wound and drawn. In addition, since, in the stabilization of the produced spun fiber, thermal melting does not occur, the shape of the fiber may be stably maintained without the occurrence of severance of the fiber.

Furthermore, the effect described above cannot be exerted by simply mixing an acrylonitrile-based polymer and a glycol-based compound. The above effect may be exerted by allowing the glycol-based compound to permeate into the acrylonitrile-based polymer in a precipitation manner, thereby providing a spun fiber in which the glycol-based compound is uniformly dispersed in the polymer. Therefore, melt spinning without occurrence of defects may be implemented, and the spun fiber may have generally uniform physical properties. As a result, significantly improved mechanical properties of the carbon fiber may be implemented.

In particular, in the case of a solution containing propylene glycol or pentylene glycol, when performing melt spinning, a winding speed may be increased to implement an average diameter of 20 μm or less of the spun fiber. In spite of providing such a fine spun fiber, after the stabilization and carbonization of the spun fiber, excellent mechanical properties of the carbon fiber may be implemented, and the carbon fiber may be stably fibrillated without shape collapse.

The b) according to the present invention is a step of melt spinning the acrylonitrile-based polymer obtained as described above to obtain a spun fiber.

The acrylonitrile-based polymer according to the related art is impossible to be melt spun, and thus a spun fiber cannot be obtained by melt spinning. On the other hand, the acrylonitrile-based polymer according to the present invention has a melting property and is thus capable of being melt spun.

Specifically, the melt spinning may be performed as follows: an acrylonitrile-based polymer is filled in a cylinder of a spinning apparatus and melted by heat, and the melted acrylonitrile-based polymer is extruded and spun in a fiber shape through a die (spinneret). After the spinning, the spun fiber is cooled and solidified at a temperature of the melting point or lower, and then may be subjected to a winding process. In addition, any melt spinning apparatus from an experimental spinning apparatus to an industrial spinning apparatus may be used without limitation.

According to an exemplary embodiment of the present invention, the melt spinning may be performed at 150 to 220° C. for 30 minutes to 2 hours. Preferably, the melt spinning may be performed at 160 to 200° C. for 30 minutes to 2 hours. When the melt spinning is performed under the above spinning condition, the glycol-based compound is allowed to remain in the spun fiber, such that excellent spinning properties of the spun fiber may be maintained.

In particular, when taking into consideration that a temperature at which the acrylonitrile-based polymer according to the related art is incompatible due to a cyclization reaction is 200° C. or higher, since the acrylonitrile-based polymer according to the present invention is capable of being melt spun even at a significantly low temperature, it is possible to obtain the spun fiber under the above condition.

According to an exemplary embodiment of the present invention, the spun fiber may be cooled to the melting point or lower while being melt spun, and may be wound while being solidified. Specifically, the cooling may be performed at 150 to 190° C. A spinning temperature (T) may be preferably −20° C. or lower and more preferably −30° C. or lower. However, the temperatures are not particularly limited as long as the cooling and solidification may be performed at the temperatures.

In addition, the winding may be performed at a winding speed of 100 m/min to 3,000 m/min. In particular, in a case where the polymer in which propylene glycol or pentylene glycol is used as the glycol-based compound is solidified and melt spun, the spun fiber may be wound at a winding speed of 300 m/min to 3,000 m/min and preferably 1,000 m/min to 3,000 m/min, and thus the productivity of the carbon fiber is significantly increased, compared to the case where another glycol-based compound is used. The winding speed is increased or decreased depending on a content ratio of the glycol-based compound, but in particular, in the case of propylene glycol or pentylene glycol under a condition of the same content, a spinning speed and winding speed are significantly excellent.

After the winding, the average diameter of the spun fiber may be 1 to 100 μm, preferably 1 to 40 μm, more preferably 1 to 25 μm, and most preferably 1 to 24 μm. The fine spun fiber having a small average diameter as described above is light, may be freely changed in shape, and may be applicable to various fields. Therefore, the productivity of the carbon fiber may be significantly increased. In addition, the fine spun fiber has an excellent fiber orientation degree, an excellent evenness of a fiber cross section, and excellent mechanical properties such as a tensile strength, an elongation, and a tensile modulus. Therefore, even after the drawing, stabilization, and carbonization are performed, a shape of the fine carbon fiber may be stably maintained.

In a case where the glycol-based compound is not used as a plasticizer, the spun fiber has an average diameter of 50 μm or more, and it is difficult to stably produce a carbon fiber without a change in shape and deterioration in mechanical properties after the stabilization and carbonization of the spun fiber. On the other hand, the carbon fiber produced by using the method of producing a carbon fiber according to the present invention may be provided as a fine fiber, and may also have excellent mechanical properties.

According to an exemplary embodiment of the present invention, the method may further include, after the b), drawing the spun fiber. The drawing is performed to convert a structure of the fiber into a physical structure in which the stabilization and carbonization of the fiber may be stably induced. Specifically, the mechanical properties of the fiber and orientation of a polymer chain in the fiber are increased by the drawing. Therefore, the fiber may be fibrillated and a stabilization reaction may be uniformly performed. In addition, in the stabilization, the stabilization temperature may be lowered, the stabilization time may be shortened, and after the carbonization, a high performance carbon fiber may be provided.

According to an exemplary embodiment of the present invention, the spun fiber may be drawn 2 times to 10 times and more preferably 2 times to 5 times a length of the fiber before being drawn. By drawing the spun fiber described above, the mechanical properties and orientation of the fiber may be further improved, and the fiber may be prevented from being severed.

According to an exemplary embodiment of the present invention, the drawing may be performed at 100 to 250° C. and preferably at 100 to 200° C. The drawing method is not particularly limited, and may be performed by a heating method using electromagnetic waves such as microwaves or infrared rays, or a drawing unit generally used. For example, the drawing may be performed at the above temperature by a hot-air dry heat method. Since the acrylonitrile-based polymer according to the present invention is capable of being melt spun at a significantly low temperature, the spun fiber may be drawn under the drawing condition as described above. Therefore, a carbon fiber having a higher density with minimized defects may be provided.

According to an exemplary embodiment of the present invention, in the c), the stabilization may be performed at 120 to 300° C. Specifically, the stabilization may be performed at 120 to 300° C. for 10 minutes to 15 hours in an oxidizing atmosphere. By performing the stabilization, a hydrogen atom is removed as a molecule in an oxidizing atmosphere by cyclization, a dehydrogenation reaction, and an oxidation reaction of a fiber molecule, or a bond between molecules is induced by a dehydration reaction. In this case, reacting oxygen atoms are evenly transmitted to the inside of the fiber, such that the entire molecular structure of the fiber may be formed into a stable hexagonal ring structure. Therefore, the fiber may have excellent thermal stability and electroconductivity.

In addition, the stabilization is performed as follows: the fiber is softened in a gel phase while raising a temperature, a component having a low boiling point is volatilized, some components are thermally decomposed and discharged out of the system, and the residual components are cyclized and aromatized to be incompatible as the reaction proceeds. By performing the stabilization as described above, the carbonization is stably induced, and the crystallinity and the mechanical strength of the carbon fiber may thus be further improved.

Furthermore, the acrylonitrile-based polymer according to the present invention has excellent uniformity, and the induction of the stabilization is thus generally smooth. Therefore, in the stabilization, the stabilization temperature may be lowered and the stabilization time may be shortened.

According to an exemplary embodiment of the present invention, an average diameter of the fiber subjected to the stabilization may be, for example, 5 to 50 μm and preferably 7 to 30 μm, but is not limited thereto. Specifically, the average diameter of the fiber subjected to the stabilization may be decreased by 20 to 50% and preferably 30 to 50% of an average diameter of the fiber subjected to the drawing. The average diameter as described above is decreased by improvement of the crystallinity and density of the fiber, which means that the carbonization may be further stably induced.

According to an exemplary embodiment of the present invention, in the c), the carbonization is performed to convert the stabilized fiber into a carbon fiber finally, and specifically, may be performed at 800 to 3,000° C. in an inert gas atmosphere. By performing the carbonization as described above, the mechanical properties of the carbon fiber may be improved while stably maintaining the fiber shape. Therefore, it is possible to produce the carbon fiber having excellent electroconductivity and thermal conductivity due to the carbonization with a high density.

According to an exemplary embodiment of the present invention, the carbonization may be performed through primary to tertiary carbonizations. Preferably, when the carbonization is performed through secondary and tertiary carbonizations, the carbonizations may be performed at different temperatures and times. As a specific example, the physical properties of the carbon fiber may be controlled through a primary carbonization at 500 to 1,000° C., a secondary carbonization at 1,000 to 1,500° C., and a tertiary graphitization at 2,000 to 3,000° C., but the present invention is not limited thereto.

According to an exemplary embodiment of the present invention, the average diameter of the carbon fiber may be, for example, 4 to 20 μm and preferably 5 to 20 μm, but is not limited thereto. Specifically, the average diameter of the carbon fiber may be decreased by 40 to 60% and preferably 45 to 60% of an average diameter of a precursor spun fiber. The carbon fiber having the average diameter as described above has a high crystallinity and a high density, and thus the carbon fiber has significantly improved mechanical properties and electroconductivity.

According to an exemplary embodiment of the present invention, a tensile strength, a tensile modulus, and an elongation of the carbon fiber measured in accordance with ASTM D 3379-75 may be 0.35 GPa or more, 85 GPa or more, and 1.1% or more, respectively. Preferably, the tensile strength, the tensile modulus, and the elongation of the carbon fiber may be 1.2 GPa or more, 95 GPa or more, and 1.5% or more, respectively. According to a more preferred exemplary embodiment, the tensile strength, the tensile modulus, and the elongation of the carbon fiber may be 1.4 to 3.0 GPa, 120 to 200 GPa, and 2.0 to 2.5%, respectively. According to a still more preferred exemplary embodiment, the tensile strength, the tensile modulus, and the elongation of the carbon fiber may be 3.0 to 4.2 GPa, 250 to 400 GPa, and 1.8 to 2.2%, respectively.

The method of producing a carbon fiber according to the present invention may implement the melt spinning of the acrylonitrile-based polymer and the excellent mechanical properties and electroconductivity of the carbon fiber. The carbon fiber may be widely utilized by this method. In addition, a process of a method of producing a carbon fiber is newly established by the method according to the present invention.

Hereinafter, the method of producing a carbon fiber according to the present invention will be described in more detail with reference to the following examples. However, the following examples are only one reference example for describing the present invention in detail, and the present invention is not limited thereto and may be implemented in various forms.

Unless otherwise defined, all technical terms and scientific terms used herein have the same meanings as commonly understood by those skilled in the art to which the present invention pertains. The terms used herein are only for effectively describing a certain example rather than limiting the present invention.

Further, unless otherwise stated herein, a unit of added materials may be wt %.

[Physical Property Measurement Method]

1. Tensile Strength, Tensile Modulus, and Elongation

A specimen was prepared, and then a tensile strength, a tensile modulus, and an elongation thereof were measured with a FAVIMAT, in accordance with ASTM D 3379-75 (Standard Test Method for Tensile Strength and Young's Modulus for High-Modulus Single-Filament Materials).

2. Diameter

Average diameters of carbon fibers of examples and comparative examples were observed with an optical microscope (Nikon, E200 LED Trino+).

Example 1

With respect to 100 moles of a monomer mixture in which an acrylonitrile monomer and a methyl acrylate monomer were mixed at a molar ratio of 90:10, 2,2'-azobisisobutyronitrile (AIBN) and 1-dodecanethiol (CTA) were mixed at molar ratios of 0.015 and 0.001, respectively, thereby preparing a mixture. The mixture was mixed with a dimethyl sulfoxide (DMSO) solvent of which a content is 2 times a content of 100 moles of the monomer mixture, and then polymerization was performed at 60° C. for 16 hours, thereby preparing an acrylonitrile-based polymer solution.

The acrylonitrile-based polymer solution was added to an aqueous solution in which ethylene glycol was dissolved at 40 vol % to precipitate an acrylonitrile-based polymer, thereby obtaining the acrylonitrile-based polymer. Thereafter, the acrylonitrile-based polymer was dried at room temperature for 24 hours, and then was vacuum dried at 60° C. for 12 hours. In this case, a total content of the ethylene glycol in the acrylonitrile-based polymer was 10 wt %, and a weight average molecular weight of the ethylene glycol was 124,000 g/mol.

Thereafter, the vacuum dried acrylonitrile-based polymer was filled in a cylinder of a spinning apparatus, and the temperature was raised up to 170° C. and held for 30 minutes to melt the acrylonitrile-based polymer.

The melt was spun at 170° C. and a nitrogen pressure of 5 bar, thereby obtaining a spun fiber having an average diameter of 35 μm. In this case, an average diameter of a spinneret used was 0.5 mm, and the spun fiber was wound at a winding speed of up to 720 m/min.

After the winding, the spun fiber was drawn at 130° C. and a draw ratio of 1.5 while circulating air with a hot air circulation duct.

The temperature was raised from 130° C. to 280° C. in air atmosphere, and the drawn spun fiber was stabilized for 1 hour. After the stabilization, the stabilized fiber having an average diameter of 23 μm was subjected to a heat treatment up to 1,100° C. in a nitrogen atmosphere, thereby producing a carbon fiber having an average diameter of 15 μm.

In addition, in order to measure a maximum spinning speed, a winding speed at which the carbon fiber is severed was measured while increasing the winding speed during the winding. The results are shown in Table 1.

Example 2

An acrylonitrile-based polymer was obtained in the same manner as that of Example 1 except that when the precipitation of the acrylonitrile-based polymer was performed, an aqueous solution in which propylene glycol was dissolved at 40 vol % instead of the ethylene glycol was added to precipitate the acrylonitrile-based polymer. Thereafter, the acrylonitrile-based polymer was dried at room temperature for 24 hours, and then was vacuum dried at 60° C. for 12 hours. In this case, a total content of the propylene glycol in the acrylonitrile-based polymer was 10.2 wt %, and a weight average molecular weight of the propylene glycol was 121,000 g/mol.

Thereafter, the vacuum dried acrylonitrile-based polymer was filled in a cylinder of a spinning apparatus, and the temperature was raised up to 170° C. and held for 30 minutes to melt the acrylonitrile-based polymer. The melt was spun at 170° C. and a nitrogen pressure of 5 bar, thereby obtaining a spun fiber having an average diameter of 32 μm. In this case, an average diameter of a spinneret used was 0.5 mm, and the spun fiber was wound at a winding speed of up to 1,800 m/min.

After the winding, the spun fiber was drawn at 130° C. and a draw ratio of 1.5 while circulating air with a hot air circulation duct.

The temperature was raised from 130° C. to 280° C. in air atmosphere, and the drawn spun fiber was stabilized for 1 hour. After the stabilization, the stabilized fiber having an average diameter of 22 μm was subjected to a heat treatment up to 1,100° C. in a nitrogen atmosphere, thereby producing a carbon fiber having an average diameter of 13 μm.

In addition, in order to measure a maximum spinning speed, a winding speed at which the carbon fiber is severed was measured while increasing the winding speed during the winding. The results are shown in Table 1.

Example 3

An acrylonitrile-based polymer was obtained in the same manner as that of Example 1 except that when the precipitation of the acrylonitrile-based polymer was performed, an aqueous solution in which butylene glycol was dissolved at 40 vol % instead of the ethylene glycol was added to precipitate the acrylonitrile-based polymer. Thereafter, the acrylonitrile-based polymer was dried at room temperature for 24 hours, and then was vacuum dried at 60° C. for 12 hours. In this case, a total content of the butylene glycol in the acrylonitrile-based polymer was 11 wt %, and a weight average molecular weight of the butylene glycol was 125,000 g/mol.

Thereafter, the vacuum dried acrylonitrile-based polymer was filled in a cylinder of a spinning apparatus, and the temperature was raised up to 170° C. and held for 30 minutes to melt the acrylonitrile-based polymer. The melt was spun at 180° C. and a nitrogen pressure of 5 bar, thereby obtaining a spun fiber having an average diameter of 46 μm.

In this case, an average diameter of a spinneret used was 0.5 mm, and the spun fiber was wound at a winding speed of 210 m/min.

After the winding, the spun fiber was drawn at 130° C. and a draw ratio of 1.5 while circulating air with a hot air circulation duct.

The temperature was raised from 130° C. to 280° C. in air atmosphere, and the drawn spun fiber was stabilized for 1 hour. After the stabilization, the stabilized fiber having an average diameter of 30 μm was subjected to a heat treatment up to 1,100° C. in a nitrogen atmosphere, thereby producing a carbon fiber having an average diameter of 18 μm.

In addition, in order to measure a maximum spinning speed, a winding speed at which the carbon fiber is severed was measured while increasing the winding speed during the winding. The results are shown in Table 1.

Example 4

An acrylonitrile-based polymer was obtained in the same manner as that of Example 1 except that when the precipitation of the acrylonitrile-based polymer was performed, an aqueous solution in which pentylene glycol was dissolved at vol % instead of the ethylene glycol was added to precipitate the acrylonitrile-based polymer. Thereafter, the acrylonitrile-based polymer was dried at room temperature for 24 hours, and then was vacuum dried at 60° C. for 12 hours. In this case, a total content of the pentylene glycol in the acrylonitrile-based polymer was 9.5 wt %, and a weight average molecular weight of the pentylene glycol was 122,500 g/mol.

Thereafter, the vacuum dried acrylonitrile-based polymer was filled in a cylinder of a spinning apparatus, and the temperature was raised up to 170° C. and held for 30 minutes to melt the acrylonitrile-based polymer. The melt was spun at 180° C. and a nitrogen pressure of 5 bar, thereby obtaining a spun fiber having an average diameter of 40 μm.

In this case, an average diameter of a spinneret used was 0.5 mm, and the spun fiber was wound at a winding speed of 1,400 m/min.

After the winding, the spun fiber was drawn at 130° C. and a draw ratio of 1.5 while circulating air with a hot air circulation duct.

The temperature was raised from 130° C. to 280° C. in air atmosphere, and the drawn spun fiber was stabilized for 1 hour. After the stabilization, the stabilized fiber having an average diameter of 25 μm was subjected to a heat treatment up to 1,100° C. in a nitrogen atmosphere, thereby producing a carbon fiber having an average diameter of 16 μm.

In addition, in order to measure a maximum spinning speed, a winding speed at which the carbon fiber is severed was measured while increasing the winding speed during the winding. The results are shown in Table 1.

Example 5

An acrylonitrile-based polymer was obtained in the same manner as that of Example 1 except that when the precipitation of the acrylonitrile-based polymer was performed, an aqueous solution in which hexylene glycol was dissolved at 40 vol % instead of the ethylene glycol was added to precipitate the acrylonitrile-based polymer. Thereafter, the acrylonitrile-based polymer was dried at room temperature for 24 hours, and then was vacuum dried at 60° C. for 12 hours. In this case, a total content of the hexylene glycol in the acrylonitrile-based polymer was 10 wt %, and a weight average molecular weight of the hexylene glycol was 126,000 g/mol.

Thereafter, the vacuum dried acrylonitrile-based polymer was filled in a cylinder of a spinning apparatus, and the temperature was raised up to 170° C. and held for 30 minutes to melt the acrylonitrile-based polymer. The melt was spun at 180° C. and a nitrogen pressure of 5 bar, thereby obtaining a spun fiber having an average diameter of 28 μm.

In this case, an average diameter of a spinneret used was 0.5 mm, and the spun fiber was wound at a winding speed of 560 m/min.

After the winding, the spun fiber was drawn at 130° C. and a draw ratio of 1.5 while circulating air with a hot air circulation duct.

The temperature was raised from 130° C. to 280° C. in air atmosphere, and the drawn spun fiber was stabilized for 1 hour. After the stabilization, the stabilized fiber having an average diameter of 19 μm was subjected to a heat treatment up to 1,100° C. in a nitrogen atmosphere, thereby producing a carbon fiber having an average diameter of 14 μm.

In addition, in order to measure a maximum spinning speed, a winding speed at which the carbon fiber is severed was measured while increasing the winding speed during the winding. The results are shown in Table 1.

Example 6

An acrylonitrile-based polymer was obtained in the same manner as that of Example 1 except that a total content of the ethylene glycol was 17 wt % in the precipitated and vacuum dried acrylonitrile-based polymer obtained by adding the acrylonitrile-based polymer solution to the aqueous solution in which ethylene glycol was dissolved at 60 vol %.

Thereafter, the vacuum dried acrylonitrile-based polymer was filled in a cylinder of a spinning apparatus, and the temperature was raised up to 170° C. and held for 30 minutes to melt the acrylonitrile-based polymer. The melt was spun at 180° C. and a nitrogen pressure of 5 bar, thereby obtaining a spun fiber having an average diameter of 32 μm.

In this case, an average diameter of a spinneret used was 0.5 mm, and the spun fiber was wound at a winding speed of 180 m/min.

After the winding, the spun fiber was drawn at 130° C. and a draw ratio of 1.5 while circulating air with a hot air circulation duct.

The temperature was raised from 130° C. to 280° C. in air atmosphere, and the drawn spun fiber was stabilized for 1 hour. After the stabilization, the stabilized fiber having an average diameter of 20 μm was subjected to a heat treatment up to 1,100° C. in a nitrogen atmosphere, thereby producing a carbon fiber having an average diameter of 15 μm.

Comparative Example 1

The acrylonitrile-based polymer solution prepared in Example 1 was added to distilled water to precipitate an acrylonitrile-based polymer, thereby obtaining the acrylonitrile-based polymer.

The acrylonitrile-based polymer obtained as described above was not melted even though the temperature was raised to 220° C. or higher and thus was not capable of being melt spun.

Comparative Example 2

The acrylonitrile-based polymer solution prepared in Example 1 was added to distilled water to precipitate an acrylonitrile-based polymer, thereby obtaining the acrylonitrile-based polymer. Thereafter, the acrylonitrile-based polymer was dried at room temperature for 24 hours, and then was vacuum dried at 60° C. for 16 hours.

External plasticization was attempted by mixing ethylene glycol with the vacuum dried powdery acrylonitrile-based polymer, in an amount of 20 wt % with respect to a total weight of the acrylonitrile-based polymer. The acrylonitrile-based polymer obtained as described above was not melted even though the temperature was raised to 210° C. or higher and thus was not capable of being melt spun.

The tensile strength, the tensile modulus, and the elongation of each of the carbon fibers produced in Examples 1 to 6 and Comparative Examples 1 and 2 were measured. The results are shown in Table 1.

TABLE 1

| | Tensile strength (GPa) | Tensile modulus (GPa) | Elongation (%) | Maximum winding speed (m/min.) |
|---|---|---|---|---|
| Example 1 | 3.5 | 351.9 | 1.97 | 720 |
| Example 2 | 1.5 | 125.9 | 2.25 | 1,800 |
| Example 3 | 1.9 | 324.2 | 2.70 | 210 |
| Example 4 | 1.5 | 155.5 | 2.06 | 1,400 |
| Example 5 | 2.0 | 98.3 | 2.46 | 560 |
| Example 6 | 0.358 | 89.16 | 1.13 | 180 |
| Comparative Example 1 | Non-measurable | Non-measurable | Non-measurable | Non-measurable |
| Comparative Example 2 | Non-measurable | Non-measurable | Non-measurable | Non-measurable |

As shown in Table 1, it could be confirmed that the carbon fiber produced by the method of producing a carbon fiber according to the present invention had a significantly excellent tensile strength, tensile modulus, and elongation. In particular, it could be confirmed that, when the carbon fiber was produced so that after the precipitation, the ethylene glycol was contained in the acrylonitrile-based polymer in an amount of 5 to 15 wt %, the ethylene glycol did not remain after the stabilization and carbonization, and the carbon fiber having a higher crystallinity was thus produced, whereby the mechanical properties of the carbon fiber may be significantly improved.

In a case where ethylene glycol was used as a plasticizer, a winding speed of the spun fiber was 500 m/min or more, which exhibited high productivity. The carbon fiber produced therefrom had the tensile strength of 3.0 GPa or more and the tensile modulus of 250 GPa or more. This means that the carbon fiber produced by using ethylene glycol as a plasticizer has very excellent mechanical properties and is cost effective.

In a case where propylene glycol or pentylene glycol was used as a plasticizer, the spun fiber was continuously wound without severance at a winding speed of 1,000 m/min or more, which exhibited very excellent spinning properties. In addition, the carbon fiber produced therefore had the tensile strength of 1.4 GPa or more, the tensile modulus of 120 GPa or more, and the elongation of 2.0% or more. This means that the carbon fiber produced by using propylene glycol or pentylene glycol as a plasticizer has very excellent productivity and is cost effectiveness.

In addition, in the method of producing a carbon fiber of each of Examples 1 to 6, since processes for solidification and recovery of the solvent are unnecessary, the cost competitiveness may be ensured as compared to that of a wet spinning method or a dry spinning method in which a solvent is inevitably used.

Accordingly, the acrylonitrile-based polymer according to the present invention is capable of being melt spun, and the carbon fiber produced therefrom has mechanical properties. Therefore, the carbon fiber may be widely applicable in universal fields such as a vehicle and construction in addition to high performance fields such as sports and aerospace.

As set forth above, the carbon fiber according to the present invention is produced from an acrylonitrile-based polymer, and may ensure improved cost competitiveness as compared to that of a carbon fiber produced by wet spinning or dry spinning, while maintaining high mechanical properties such as a tensile strength, a tensile modulus, and an elongation.

Further, the carbon fiber according to the present invention may have excellent thermal stability and electroconductivity, and may have improved crystallinity in an axial direction of the fiber.

Further, the method of producing a carbon fiber according to the present invention may implement the winding of a spun fiber at a winding speed increased 7 times or more and more preferably 10 times or more that of a wet spinning method, whereby high productivity, crystallinity according to an axial direction of the spun fiber, and orientation of a polymer chain in the spun fiber may be increased.

Further, the method of producing a carbon fiber according to the present invention may implement a precursor spun fiber used to produce the carbon fiber that has an average diameter of 50 μm or less and more preferably 20 μm or less, whereby the carbon fiber may be fibrillated.

Hereinabove, although in the present invention the method of producing a carbon fiber has been described by specific matters and exemplary embodiments, they have been provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to these exemplary embodiments, but the claims and all of modifications equal or equivalent to the claims are intended to fall within the scope and spirit of the invention.

What is claimed is:

1. A method of producing a carbon fiber, the method comprising:

a) adding an acrylonitrile-based polymer solution to a solution containing a glycol-based compound having a boiling point of 180 to 210° C. to precipitate an acrylonitrile-based polymer for obtaining an acrylonitrile-based powder;

b) melt spinning the acrylonitrile-based polymer powder to obtain a spun fiber; and c) performing stabilization and carbonization on the spun fiber to obtain a carbon fiber;

wherein the acrylonitrile-based polymer has a repeating unit derived from an acrylonitrile monomer and an acrylic monomer.

2. The method of claim 1, wherein the glycol-based compound is C2-C10 alkylene glycol.

3. The method of claim 2, wherein the glycol-based compound is one or a mixture of two or more selected from the group consisting of ethylene glycol, propylene glycol, butylene glycol, pentylene glycol, and hexylene glycol.

4. The method of claim 1, wherein the acrylonitrile-based polymer has the repeating unit including 50 to 97 mol % of the acrylonitrile monomer and 3 to 50 mol % of the acrylic monomer.

5. The method of claim 1, further comprising, after the a), but before the b), drying the acrylonitrile-based polymer powder.

6. The method of claim 5, wherein, after the drying, a content of the glycol-based compound in the acrylonitrile-based polymer powder is 5 to 15 wt % with respect to a total weight of the acrylonitrile-based polymer powder.

7. The method of claim 1, further comprising, after the b), drawing the spun fiber.

8. The method of claim 7, wherein the drawing is performed at 100 to 250° C.

9. The method of claim 1, wherein, in the c), the stabilization is performed at 120 to 300° C.

10. The method of claim 1, wherein, in the c), the carbonization is performed at 800 to 3,000° C. in an inert gas atmosphere.

11. The method of claim 1, wherein the glycol-based compound is propylene glycol or pentylene glycol and further comprising, after the b), winding the spun fiber at a winding speed of 300 to 3,000 m/min.

12. The method of claim 11, wherein, after the winding, an average diameter of the spun fiber is 1 to 50 μm.

13. The method of claim 5, wherein, after the drying step and before the step b), the acrylonitrile-based polymer powder is transferred to an apparatus for performing the melt-spinning step b).

14. The method of claim 1, the solution containing a glycol-based compound further comprising a solvent, wherein the solvent does not dissolve but precipitates the acrylonitrile-based polymer.

15. The method of claim 1, the acrylonitrile-based polymer solution further comprising an organic solvent, wherein the organic solvent is capable of dissolving the monomers of the acrylonitrile-based polymer.

16. The method of claim 1, in the step b), the acrylonitrile-based polymer powder is heated up to a temperature between 160° C. and 200° C.

* * * * *